United States Patent [19]

Waluk

[11] 4,432,593

[45] Feb. 21, 1984

[54] ELECTRICAL LAMP SOCKET HOLDER

[75] Inventor: Stanley P. Waluk, Attleboro, Mass.

[73] Assignee: Carol Cable Company, Inc., Pawtucket, R.I.

[21] Appl. No.: 346,943

[22] Filed: Feb. 8, 1982

[51] Int. Cl.[3] ..... H01R 13/58

[52] U.S. Cl. ..... 339/105; 339/206 L; 339/208

[58] Field of Search ..... 339/105, 107, 208, , 339/210 T, 206 L

[56] References Cited

U.S. PATENT DOCUMENTS

| | | | |
|---|---|---|---|
| 2,169,868 | 8/1939 | Benander | 339/208 X |
| 2,457,521 | 12/1948 | Benander | 339/208 X |
| 3,810,075 | 5/1974 | Turner | 339/105 |

FOREIGN PATENT DOCUMENTS

| | | | |
|---|---|---|---|
| 2069254 | 8/1981 | United Kingdom | 339/105 |

*Primary Examiner*—Eugene F. Desmond

*Attorney, Agent, or Firm*—Salter & Michaelson

[57] ABSTRACT

A socket holder for an electrical lamp socket and the like is disclosed. The socket holder includes a casing that comprises a pair of longitudinally split casing halves which are preferably molded of an electrical insulative material in identical configuration and which define an interior chamber therebetween for receiving a lamp socket. Various elements are integrally molded in the halves to maintain them in proper registration and to prevent relative rotational and longitudinal movement of the socket in the holder. Cooperating baffles as formed in the casing halves further define tortuous paths therebetween to provide a strain relief for the electrical wires that are connected to the socket.

9 Claims, 5 Drawing Figures

ELECTRICAL LAMP SOCKET HOLDER

BACKGROUND AND SUMMARY OF THE INVENTION

The instant invention relates to holders for electrical lamp sockets and the like and more particularly to a holder of the type comprising a casing having a pair of longitudinal casing halves which cooperate to retain an electrical lamp socket therebetween.

A number of lamp socket holders which comprise pairs of longitudinal casing halves are currently known. In this connection the U.S. Pats. to Larsen No. 1,109,589, Willets, No. 1,191,641, Klien, No. 1,228,028, Muldoon, No. 1,986,895, Benander, No. 2,169,868, Pollock, No. 2,360,444, Benander, No. 2,457,521, Benander, No. 2,505,518, Fromer, No. 2,874,366, Irvine, No. 3,416,124 and Collier, No. 4,101,187 represent the closest prior art to the instant invention of which the applicant is aware. The above referred to patents teach the use of both metallic and plastic casing constructions for a variety of applications.

The holder of the instant invention is a significant improvement over the holders of the prior art in that it comprises a pair of longitudinal casing halves which may be of identical configuration for simplicity in manufacturing and which are interfitted in aligned relation to provide a comparatively rigid assembly which approximates a holder of unitary construction. Since the casing halves are molded of an insulative plastic material, it is possible to incorporate longitudinal ribs and grooves therein along the longitudinal edges of the halves as well as assembly pins and cooperating positioning pins and holes which elements cooperate to positively maintain the halves in registration. Also molded in the halves are inwardly extending hub portions having semicircular projections and grooves in the terminal ends thereof which cooperate in interfitted relation to retain the hub portions in alignment. Strain relief baffles extend outwardly from the hub portions in longitudinally offset relation to define cooperating pairs of adjacent offset baffles on opposite sides of the halves for frictionally retaining insulated wires connected to the socket in tortuous paths on opposite sides of the hub portions. Also provided and extending inwardly in the halves adjacent to the hub portions are raised bosses which have upwardly disposed notches therein. The bosses are provided for receiving the downwardly extending lugs on certain types of electrical sockets to prevent socket rotation in the holder.

The combination of all of the above features in the socket holder of the instant invention provides a unique socket construction which has significant advantages over the prior art. In this connection the two casing halves of the holder are firmly held in aligned relation by the various interfitting components thereof. Electrical wires leading to the socket in the casing are firmly retained by the strain relief baffles so that further strain relief means are unnecessary; and rotational movement of the socket in the holder is prevented by the engagement of lugs as formed on the socket with notches as formed in the casing bosses.

Accordingly, it is the primary object of the instant invention to provide a holder for lamp sockets and the like having a pair of longitudinally split casing halves which are interfitted in aligned relation to form a comparatively rigid holder construction.

A further object of the instant invention is to provide a holder for lamp sockets and the like having offset strain relief baffles therein which cooperate to provide strain relief for electrical wires leading to a socket in the holder.

Another object of the instant invention is to provide a holder for lamp sockets and the like having means formed therein for preventing rotational movement of the socket.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
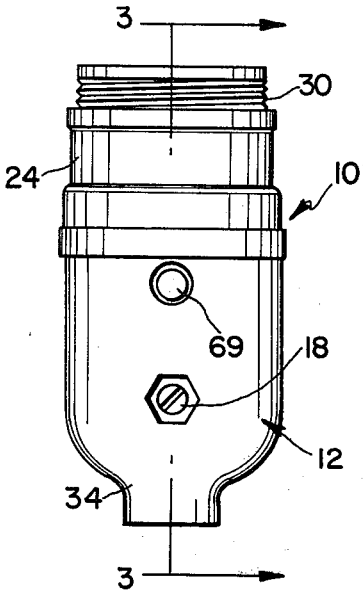
FIG. 1 is a side elevational view of the electrical socket holder of the instant invention.
Figure 2:
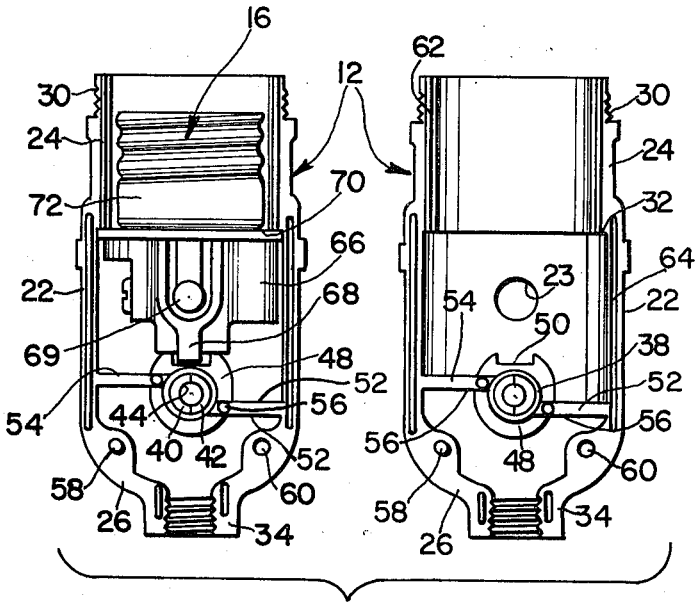
FIG. 2 is an exploded side elevational view thereof illustrating the two casing halves of the holder with an electrical lamp socket located in one of the halves.
Figure 3:
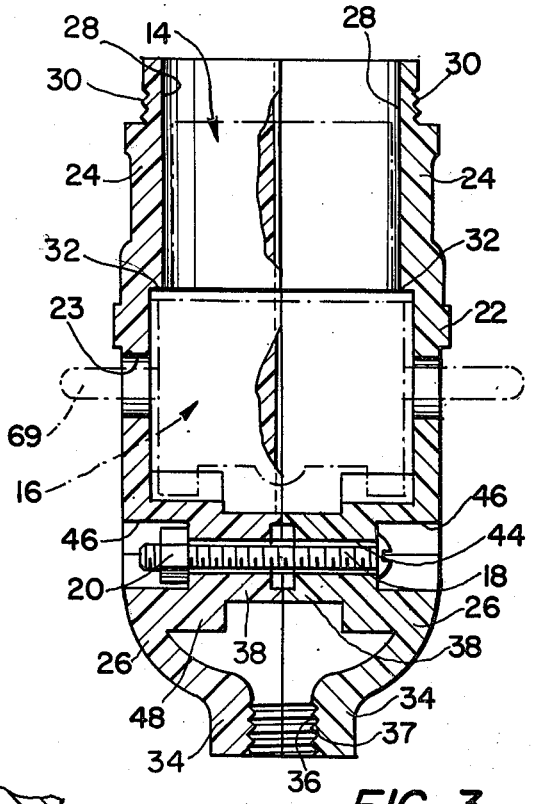
FIG. 3 is an enlarged sectional view taken along line 3—3 in FIG. 1.

Referring now to the drawing, particularly to FIGS. 1 through 3, the socket holder of the instant invention is illustrated and generally indicated at 10. The socket holder 10 generally comprises a casing that includes a pair of identical longitudinal casing halves each of which is generally indicated at 12. The casing halves 12 are molded of a plastic insulated material such as a phenolic resin and interfit in cooperating relation as will be described to define an interior chamber 14 of substantially circular cross section for receiving a lamp socket generally indicated at 16. The casing halves 12 are retained in the assembled positions thereof by a bolt 18 and a nut 20 as will be more fully set forth hereinafter.

Figure 4:
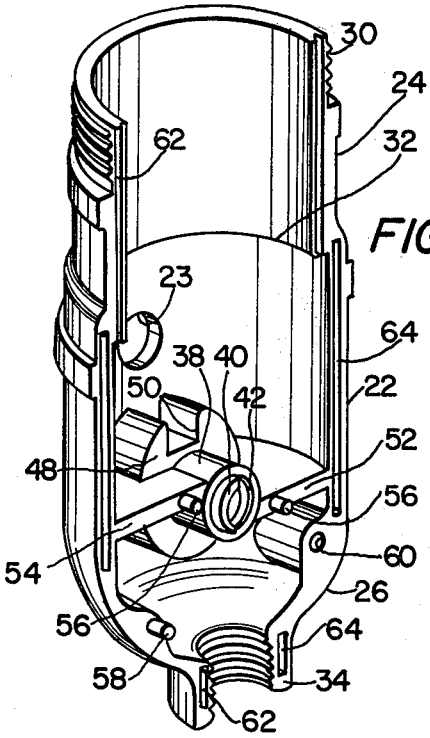
FIG. 4 is an enlarged perspective view of one of the casing halves of the holder.

As is most clearly shown in FIG. 4, the casing halves 12 include longitudinal shell portions of generally semicircular cross section which cooperate to define the interior chamber 14 and comprise longitudinally extending central shell portions 22 having openings 23 therethrough, slightly reduced upper shell portions 24, and reduced lower stem portions 26. The upper shell portions 24 define an opening 28 at the upper end of the holder 10 which communicates with the chamber 14 for receiving a light bulb or the like in the socket 16. Exterior threads 30 adjacent the upper ends of the upper shell portions 24 provide means for receiving an electrical lamp fixture element on the holder 10. The intersection between the upper and central shell portions 22 and 24 is defined by an interior shoulder 32. The lower stem portion 26 terminates in a reduced lower stem 34 which defines a lower opening 36 communicates with the chamber 14 for receiving electrical wires or the like secured to the socket 16. Threads 37 in the opening 36 are for securing the holder 10 in threaded engagement on a conventional lamp stand or the like although it will be understood that other embodiments of the holder 10 are contemplated wherein alternate means are provided for securing the holder 10 to a lamp stand or the like.

As will be further seen from FIG. 4, integrally molded hubs 38 extend inwardly from the central shell portions 22 having coaxial semicircular projections 40 and semicircular slots 42 on the inner terminal ends thereof which are disposed on opposite sides of the vertical diameters of said ends. As will be seen from FIG. 4, when the halves 12 are in assembled relation, the inner terminal ends of the opposite hubs 38 abut substantially on the longitudinal axis of the holder 10 with the projections 40 and the slots 42 of the opposite halves 12 cooperating in interfitted relation to retain the hubs 38 in axially alignment. Extending axially through each of the hubs 38 is a bore 44 for receiving the bolt 18 and a hexagonal socket 46 is also formed in each of the hubs 38 and communicates with the bore 44. The hexagonal nut 20 is receivable in nonrotational relation in one of the sockets 46 to facilitate the threaded engagement thereof on the bolt 18 during the assembly of the holder 10. It is understood, however, that other embodiments of the holder 10 are contemplated wherein alternative means are provided for retaining the halves 12 in assembled relation such as integrally molded eyelets on the exteriors thereof which are secured together with bolts or other suitable means.

Also integrally molded in the halves 12 are bosses 48 which coextend inwardly a short distance from the central shell portions 22 surrounding the hubs 38 and which have upwardly disposed notches 50 therein. The bosses 48 cooperate to positively position the socket 16 in the holder 10 as will be hereinafter more fully brought out.

Figure 5:
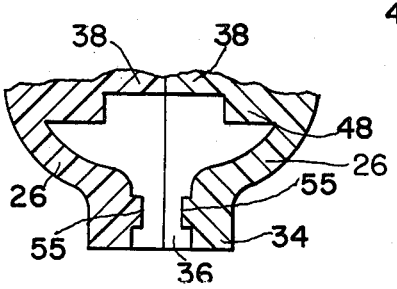
FIG. 5 is an enlarged fragmentary sectional view of the stem portion of an alternate embodiment of the holder.

Longitudinally offset strain relief baffles 52 and 54 extend outwardly from opposite sides of the hubs 38 with the edges thereof substantially along the central longitudinal plane defined by the intersection of two halves 12. As herein embodied, the baffles 52 and 54 are disposed in offset, parallel relation although it will be understood that other embodiments of the halves 12 which include baffles disposed in other positions are contemplated. When the halves 12 are in assembled relation, the offset baffles 52 and 54 of each casing cooperate with the corresponding offset baffles of the other casing to provide a strain relief for electrical wires connected to the socket 16 and the holder 10 by defining tortuous paths for said wires on opposite sides of the hubs 38. Thus the wires extend over and between the opposed baffles 52 and 54 of the opposite casing halves 12. In an alternate form of the invention shown in FIG. 5, studs 55 are formed inwardly in the stem 34 and are frictionally engageable with said wires to provide an additional strain relief therefor.

Several different elements are integrally molded in the casing halves 12 which cooperate in interfitting relation to maintain the halves 12 in registry. In this connection assembly pins 56 extend outwardly from the baffles 52 and 54 and engage the outer surfaces of the hubs 38 of the opposite halves 12 to positively align the opposite hubs 38 thereof during the assembly of the holder 10. Similarly, cooperatively interfitting pins 58 and holes 60 formed on the lower shell portions 26 and cooperatively interfitting longitudinally extending ribs 62 and slots 64 that are located on the longitudinal edges of the stems 34, the central shell portions 22 and the upper shell portions 24 act to maintain the halves 12 in registry when the halves are interfitted together.

In assembled relation the halves 12 cooperate to positively retain the socket 16 in the chamber 14 so that substantial relative longitudinal or rotational movement of the socket 16 therein is prevented. As illustrated in FIG. 2, the socket 16 includes a body portion 66 having downwardly extending lugs 68, an outwardly extending switch element 69, an intermediate peripheral ring 70 and a threaded sleeve portion 72. When the socket 16 is located in the chamber 14, the elements 69 are received in the openings 23 and the lugs 68 are received in the notches 50 to prevent relative rotational movement and downward longitudinal movement of the socket 16 in the holder 10. This also prevents the switch element 69 from engaging the sides of the openings 23. As shown in FIG. 2, upward longitudinal movement of the socket 16 is prevented by the engagement of the shoulder 32 with the ring 70.

It is understood that other embodiments of the socket holder of the instant invention are contemplated wherein the holder is adapted to accomodate switches of different configurations, such as those having pull chain switch elements, rotatable knob switch elements or no internal switch elements at all. Obviously, in these embodiments, one or both of the openings 23 will not be necessary.

It is seen therefore that the instant invention provides a novel socket holder construction which has particular advantages over the holders of the prior art. The casing halves 12 are preferably integrally molded and of identical configuration which provides advantages of simplicity in manufacturing. The halves 12 cooperate in interfitted relation to assure proper alignment thereof and to provide a comparatively rigid holder construction. The socket 16 is positively retained in the chamber 14 so that significant relative longitudinal or rotational movement thereof is prevented. The baffles 52 and 54 provide a strain relief for electrical wires connected to the socket 16. In combination these features cooperate to define advantages for the holder 10 that provide for substantial commercial significance.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A holder for an electrical lamp socket and the like comprising:

a. a pair of substantially identical opposed longitudinal casing halves which are formed of an electrical insulating material and which include shell portions that cooperate in assembled relation to define an interior chamber for retaining an electrical lamp socket therein, said chamber communicating with the exterior of said holder through an enlarged upper opening for receiving an electrical bulb or the like in said socket and through a reduced lower opening for receiving a pair of electrical wires connected to said socket, each of said halves further including a hub portion which extends inwardly in substantially aligned relation with respect to the corresponding hub portion of the opposed half, said aligned hub portions abutting interiorly of said chamber, and a pair of longitudinally offset baffles extending outwardly from opposite sides of said hub portions terminating at the adjacent edges of the respective shell portions, the adjacent baffles of the opposite halves cooperating to define a pair of tortuous paths in said holder on opposite sides of said hub portions for receiving and retaining said wires on opposite sides of said hub portion; and b. means retaining said halves in assembled relation.

2. In the holder of claim 1, said socket further characterized as having at least one downwardly extending positioning lug, at least one of said shell portions further characterized as having a side opening therethrough for receiving a switch element of said socket, at least one of said halves further comprising means for receiving said lug to prevent rotation of said socket in said holder.

3. The holder of claim 1, further comprising means retaining the opposed longitudinal edges of said halves in registry.

4. In the holder of claim 3, said means for retaining said edges comprising longitudinal ribs and grooves that are formed along said edges and which cooperate to retain said halves in interfitted relation.

5. The holder of claim 1, further comprising means for retaining said hub portions in aligned relation.

6. In the holder of claim 5, the inner ends of said hub portions having grooves therein and projections which extend outwardly therefrom, said projections being received in the grooves in the opposite hub portions, whereby said projections and grooves cooperate in interfitted relation to comprise said hub retaining means.

7. In the holder of claim 6, said grooves and said projections further characterized as being of semicircular configuration.

8. In the holder of claim 7, said hub portions having axial openings therethrough, said means for retaining said halves in assembled relation comprising nut and bolt means extending through said hub openings.

9. In the holder of claim 2, at least one of said halves further comprising shoulder means which extends inwardly from the shell portion thereof and which is engageable with the socket to prevent upward movement thereof in said chamber and to thereby retain said lug in said lug receiving means.

* * * * *